United States Patent [19]

Bell

[11] Patent Number: 5,069,384

[45] Date of Patent: Dec. 3, 1991

[54] ENVELOPES

[76] Inventor: Laurence J. Bell, 110 Rathmines Road, Hawthorn, Victoria 3122, Australia

[21] Appl. No.: 431,309

[22] Filed: Nov. 3, 1989

Related U.S. Application Data

[63] Continuation-in-part of Ser. No. 67,644, Jun. 26, 1987, Pat. No. 4,896,821, which is a continuation-in-part of Ser. No. 853,547, Apr. 18, 1986, abandoned.

[30] Foreign Application Priority Data

Apr. 19, 1985 [AU] Australia ..... PH00222/85

[51] Int. Cl.[5] ..... A65D 27/10

[52] U.S. Cl. ..... 229/69; 229/80

[58] Field of Search ..... 229/69, 80

[56] References Cited

U.S. PATENT DOCUMENTS

| | | | |
|---|---|---|---|
| 722,038 | 3/1903 | Pidgeon | 229/69 |
| 2,092,149 | 9/1937 | Berkowitz | 229/80 |
| 3,547,343 | 1/1967 | Alton . | |
| 3,559,875 | 11/1969 | Wilson . | |
| 3,565,728 | 2/1971 | Alton | 229/69 |
| 3,758,025 | 9/1973 | Schafer | 229/69 |
| 3,790,068 | 2/1974 | Stutz . | |
| 4,066,206 | 1/1978 | Peterson . | |
| 4,084,741 | 4/1978 | Heimann . | |
| 4,343,430 | 8/1982 | Martineau . | |
| 4,454,980 | 6/1984 | Poehler . | |

FOREIGN PATENT DOCUMENTS

| | | | |
|---|---|---|---|
| 134151 | 3/1985 | European Pat. Off. . | |
| 2838083 | 6/1978 | France . | |
| 567924 | 3/1945 | United Kingdom . | |
| 757151 | 9/1956 | United Kingdom . | |
| 841500 | 7/1960 | United Kingdom | 229/69 |

*Primary Examiner*—Stephen P. Garbe

*Attorney, Agent, or Firm*—Scully, Scott, Murphy & Presser

[57] ABSTRACT

The present invention provides an article of stationery defined by a continuous length of paper or other suitable material which is folded to define a plurality of envelopes. Each envelope, except for the envelopes at each end of the length of material, is partly overlapped by and attached to another adjacent envelope. The article of stationery is not more than three layers thick throughout substantially its whole length.

52 Claims, 10 Drawing Sheets

FIG. 6
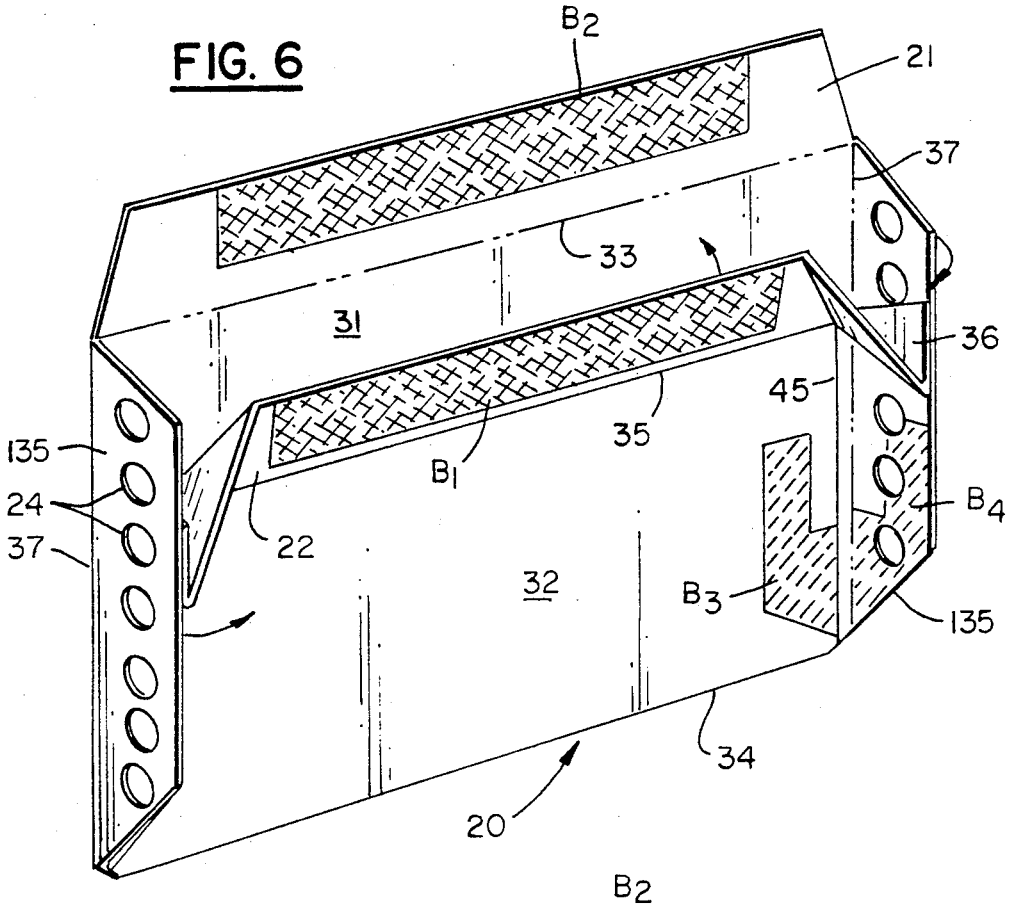
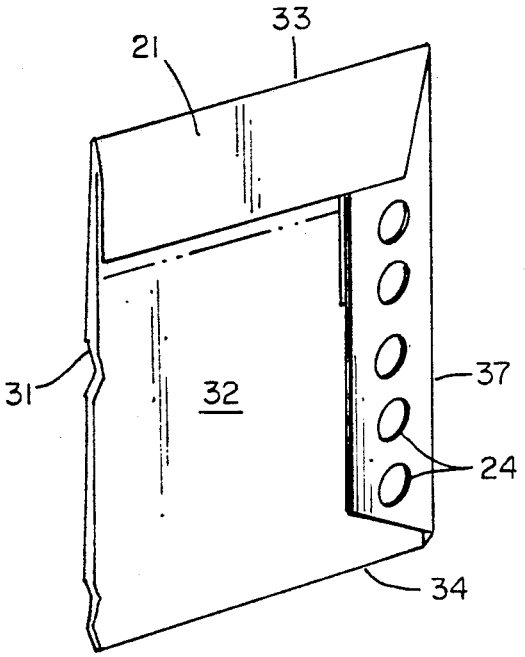
FIG. 8
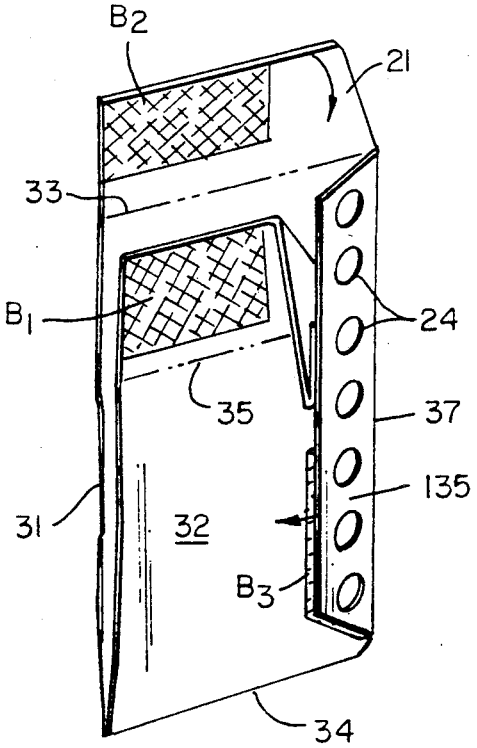
FIG. 7

ENVELOPES

This application is a continuation-in-part of copending application Ser. No. 67,644, filed June 26, 1987, now U.S. Pat. No. 4,896,821 which in turn is a continuation-in-part of prior application Ser. No. 853,547, filed Apr. 18, 1986, now abandoned.

This invention relates to an article of stationery and in a particular aspect relates to envelopes.

In a particularly preferred instance the present invention provides an article of stationery comprising a continuous length of paper or other material suitable for envelope formation folded to define a plurality of envelopes wherein each envelope, excepting that one at one end of the length, partly overlaps and is attached, per the continuity of said length, to a first adjacent envelope and, excepting that one at the other end of the length, is partly overlapped by and is attached, per the continuity of said length, to another, second, adjacent envelope, wherein each envelope comprises a face or face panel and a back or back panel and wherein at least substantially the whole of the face of each envelope is not overlapped by an adjacent envelope wherein said article of stationery is, at least substantially throughout the whole of its length and notwithstanding such overlap, not more than 3 layers thick of said paper or other material suitable for envelope formation and wherein said article of stationery is, at least substantially throughout the whole of the width of each envelope, and notwithstanding such overlap, not more than 3 layers thick of said paper or other material suitable for envelope formation.

Preferably said article of stationery is, at least substantially throughout the whole of the length and width of each envelope and notwithstanding such overlap, of a substantially constant thickness of 3 layers thick of said paper or other material suitable for envelope formation.

Preferably attached to the face of each envelope, per the continuity of said length, is a first seal tab adapted to be folded to the rear of the envelope to seal the envelope.

Preferably attached to the back of each envelope, per the continuity of said length, is a second seal tab over which the first seal tab may be folded to seal the envelope.

Preferably adjacent envelopes are attached to one another per the continuity of said length through the first tab of one envelope being attached and continuous to the second tab of an adjacent envelope.

Preferably one or both of the first seal tab and the second seal tab is provided with an adhesive. That adhesive may be a moisture activatable adhesive but more preferably is a pressure-sensitive adhesive.

Preferably the length of the first tab and the length of the second tab are such that at least substantially the whole of the face of each envelope is not overlapped by an adjacent envelope.

More preferably the length of the first tab and the length of the second tab are such that the whole of the face of each envelope is not overlapped by an adjacent envelope.

Preferably the sum of twice the length of the first tab and the length of the second tab, is not less than the length of the face of the envelope.

In one instance the sum of twice the length of the first tab and the length of the second tab, is not greater than the length of the face of the envelope plus not more than 10 mm.

Preferably the length of the first tab and the length of the second tab is such that, when the first tab is folded to seal the envelope, the first tab overlies and wholly covers the second tab.

That attachment of the first tab of one envelope to the second tab of an adjacent envelope is via a line of preferential tearing along which the envelopes may be separated.

Preferably the second tab of each envelope is folded to overlie the back of the envelope.

Preferably the second tab is unfoldable from that position overlying the back whereby the first tab may be folded to overlie or underlie the second tab to seal the envelope.

In one instance the second tab is secured to the back of the envelope in such overlying the back of the envelope condition.

The second tab may be detachably secured to the back of the envelope in such overlying the back of the envelope condition by an adhesive from which securement the second tab is capable of being de-adhered.

In another instance the second tab is secured to the back of the envelope in such overlying the back of the envelope condition by an adhesive from which the second tab is incapable of being de-adhered without substantial likelihood of tearing of said paper or other material suitable for envelope formation.

Preferably the length of the first tab and the length of the second tab is such that, when the first tab is folded to seal the envelope, the first tab overlies and wholly covers the second tab.

Preferably the first tab is joined to the face via a line, real, imaginary or of preferential folding, and the back, at least adjacent the side edges thereof, extends substantially to that line.

Preferably the first tab is joined to the face via a line, real, imaginary or of preferential folding, and the back, at least adjacent the side edges thereof, extends substantially to that line and wherein the second tab is folded to overlie the back along a fold and wherein said fold line is relatively more adjacent the bottom of the envelope than those regions of the back adjacent the side edges thereof which are most proximate to that line between the first tab and the face.

Preferably said article of stationery has side edges provided with sprocket holes for use with sprocket feed printers.

Preferably such perforations, and/or lines of preferential folding or tearing which extend across the side edges either do not extend in lines which pass through the sprocket holes or extend in lines which pass through substantially the centre of a sprocket hole.

Preferably said edges are attached to the envelopes via a line of preferential tearing whereby said side edges may be stripped from the envelope.

Preferably said side edges are continuous along the whole length of said article of stationery.

Preferably said side edges comprises regions wherein said length of material is overlapped on itself.

Preferably said side edges are provided with adhesive regions whereby to secure such overlapped regions together.

Preferably said adhesive regions are located such as to secure the side edges associated with one envelope adjacent the bottom thereof to the side edges associated with the adjacent envelope which is overlapped thereby.

Preferably the face and back of each envelope are not secured together in a region along their side edges whereby to permit air entrapped in each envelope in passing through a mechanism to escape.

In one instance the face and back of each envelope are bonded together inboard of said side edges.

In another instance the envelopes have side edges extending from the sides of one of the front and the back which are folded inwardly and secured to the other of the front and the back whereby to close the sides of the envelopes.

Preferably the envelopes have side edges extending from the sides of the back which are folded inwardly and secured to the inside of the front whereby to close the sides of the envelopes.

In one instance the side edges extending from the sides of the back which are folded inwardly are provided with sprocket holes to facilitate transport of said length prior to such folding inwardly.

Preferably the front has side edges extending laterally outwardly of the envelopes and provided with sprocket holes for use with sprocket feed printers.

Most preferably the envelopes have side edges extending from the sides of the back and integral therewith which are folded inwardly and secured to the inside of the front whereby to close the sides of the envelopes, wherein the envelopes have side edges integral with the front and extending laterally outwardly of the envelopes and provided with sprocket holes for use with sprocket feed printers, wherein said side edges integral with the front are attached to the envelopes via a line of preferential tearing whereby said side edges may be stripped from the envelope, and wherein said line of preferential tearing is located laterally outboard of the sides of the back of the envelopes.

Preferably said side edges integral with the front are continuous along the whole length of said article of stationery.

Preferably said side edges integral with the front comprise regions wherein said length of material is overlapped on itself.

The article of stationery may be in fanfold form.

The article of stationery may include lines of preferential folding in certain ones of said envelopes to facilitate such fan folding.

Preferably the first tab is attached to the face of each envelope about a line of preferential folding and said article of stationery is adapted to fanfold at that line.

In one instance the second tab or an extension thereof is connected to the side edges of the respective envelope so as to cause folding of those side edges to overlap the back when the second tab is unfolded as aforesaid.

Preferably lines of preferential folding are provided spaced from side edges and in the second tab or said extension to facilitate such folding of the side edges.

Preferably one of said back and said side edges is provided with an adhesive adapted to retain said side edges in such folded condition.

There may be a second set of sprocket holes in said side edges outboard of the first mentioned sprocket holes.

Preferably said second set of sprocket holes is spaced from the first mentioned sprocket holes by a region having a line of preferential tearing whereby that part of the side edges having said second set of sprocket holes may be stripped from the envelopes.

In one instance in the regions of said article of stationery in which part of one envelope overlaps part of another, adjacent, envelope the side edges of, respectively, the overlapping envelope or the overlapped envelope in way of the sprocket holes therein extend relatively more laterally than, respectively, the side edges of the overlapped envelope or the overlapping envelope whereby, in use, a sprocket feed mechanism will engage with sprocket holes in the parts of the side edges which extend relatively more laterally and not with, respectively, the side edges of the overlapped envelope or the overlapping envelope.

In one instance the first tab is attached to the back of an adjacent envelope per the continuity of said length.

Preferably attached to the back of each envelope, per the continuity of said length, is a second tab over or under which the first tab may be folded to seal the envelope and wherein adjacent envelopes are attached to one another per the continuity of said length through the first tab of one envelope being attached and continuous to a removable portion intermediate, in the continuity of said length, the first tab and the second tab of an adjacent envelope.

Preferably said removable portion is defined by lines of preferential tearing at intersections with the first tab and the second tab.

In one instance the envelopes have side edges extending from the sides of the back which are folded inwardly and secured to the inside of the front whereby to close the sides of the envelopes and wherein the first tab and the second tab are so shaped as to not overlie said side edges extending from the sides of the back which are folded inwardly.

Two or more such articles of stationery may be arranged in side-by-side relation to produce a composite article having two or more envelopes across its width.

Articles of stationery in accordance with this invention may be in single sheet form or continuous form.

BRIEF DESCRIPTION OF THE DRAWINGS

Specific constructions of articles of stationery in accordance with this invention will now be described with the aid of the accompanying drawings in which:

FIG. 6 is a view corresponding to FIG. 5 but showing the envelope in partly folded condition, FIG. 7 is a view corresponding to FIG. 5 but showing the envelope in partly folded condition, FIG. 8 is a view corresponding to FIG. 5 but showing the envelope in fully folded condition.

DETAILED DESCRIPTION OF THE PREFERRED EMBODIMENTS

Figure 1:
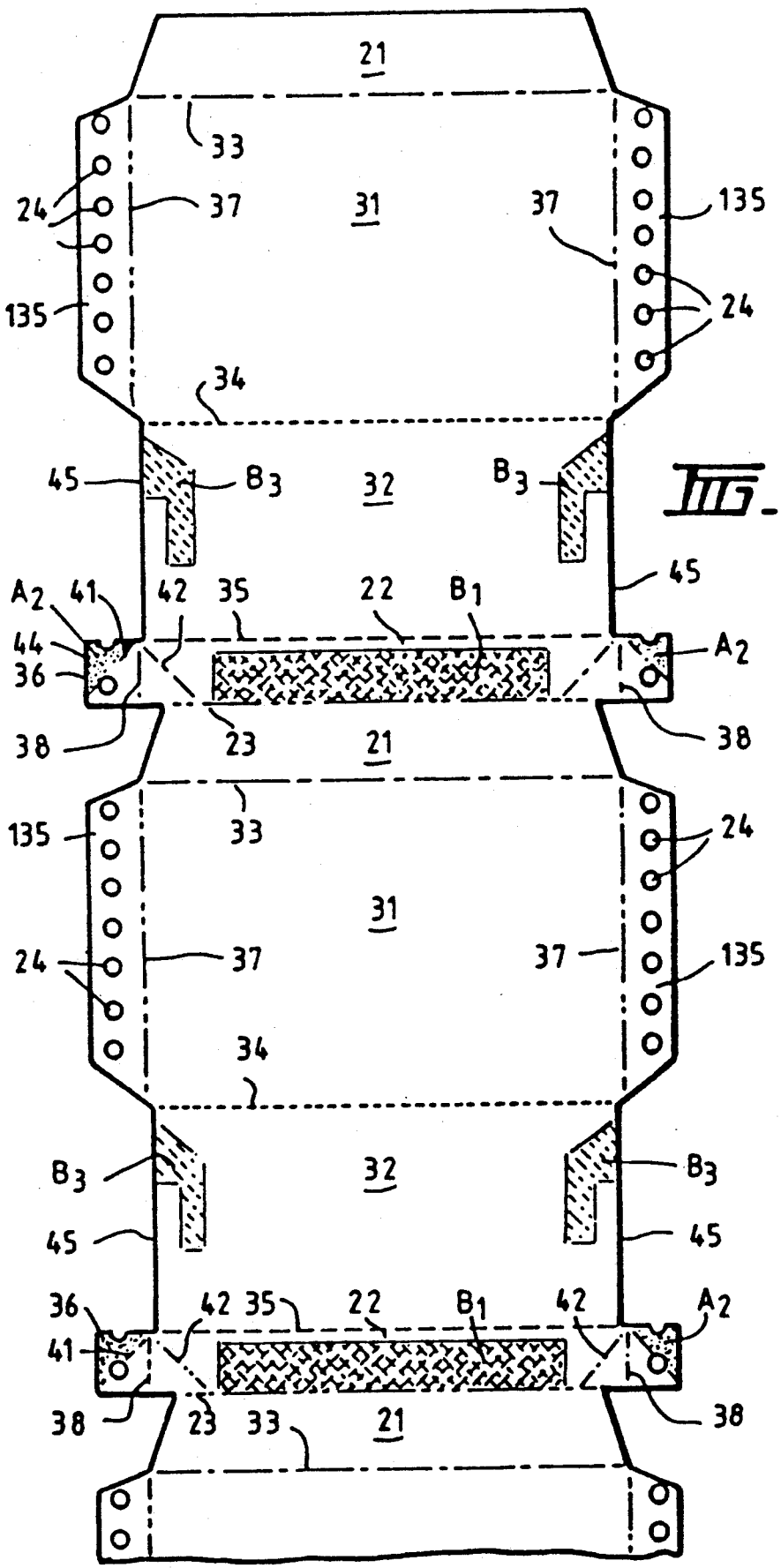
FIG. 1 is a plan view from one side of a sheet of paper used to form an article of stationery in accordance with this invention, which article being shown in FIG. 3.
Figure 2:
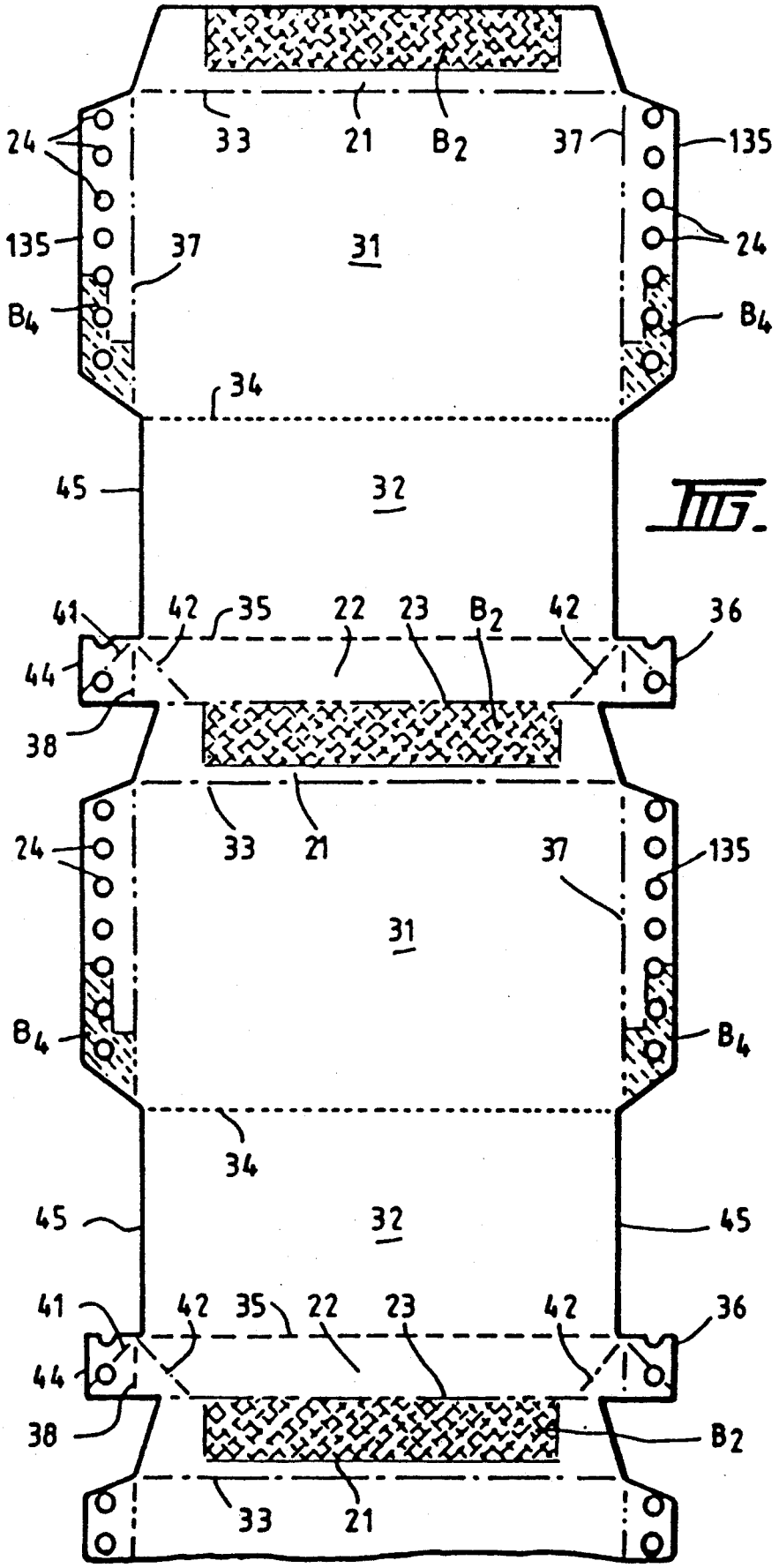
FIG. 2 is a plan view from the opposite side of the sheet of FIG. 1.

To facilitate understanding of the accompanying drawings and in particular FIGS. 1 and 2, the following legend has been used:

(a) Long dash-2 short dash-long dash. This indicates a line of perforations.

(b) Short dashes. This indicates a fold line which is present in the article of stationery.

(c) Long dash-short-dash-long dash. This indicates a fold to be made in use.

(d) Long dashes. This indicates a fold line which is present in the article of stationery but which is to be unfolded in use.

(e) Stipple hatching. This represents adhesive type A.

(f) Cross-hatching. This represents adhesive type B or type C.

(g) Oblique dash hatching. This represents adhesive type B.

Figure 3:
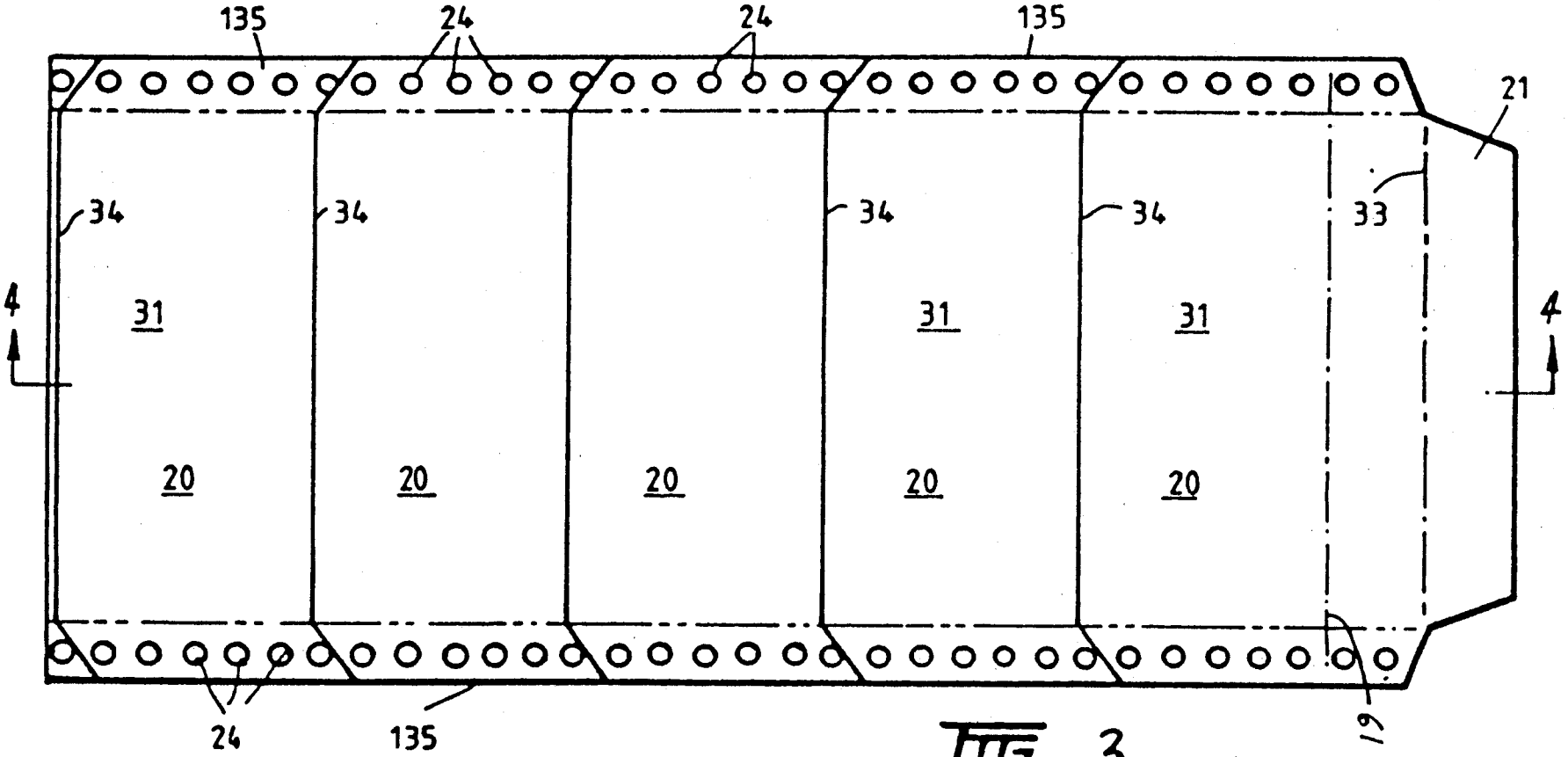
FIG. 3 is the article of stationery formed by folding the sheet shown in FIGS. 1 and 2.
Figure 4:
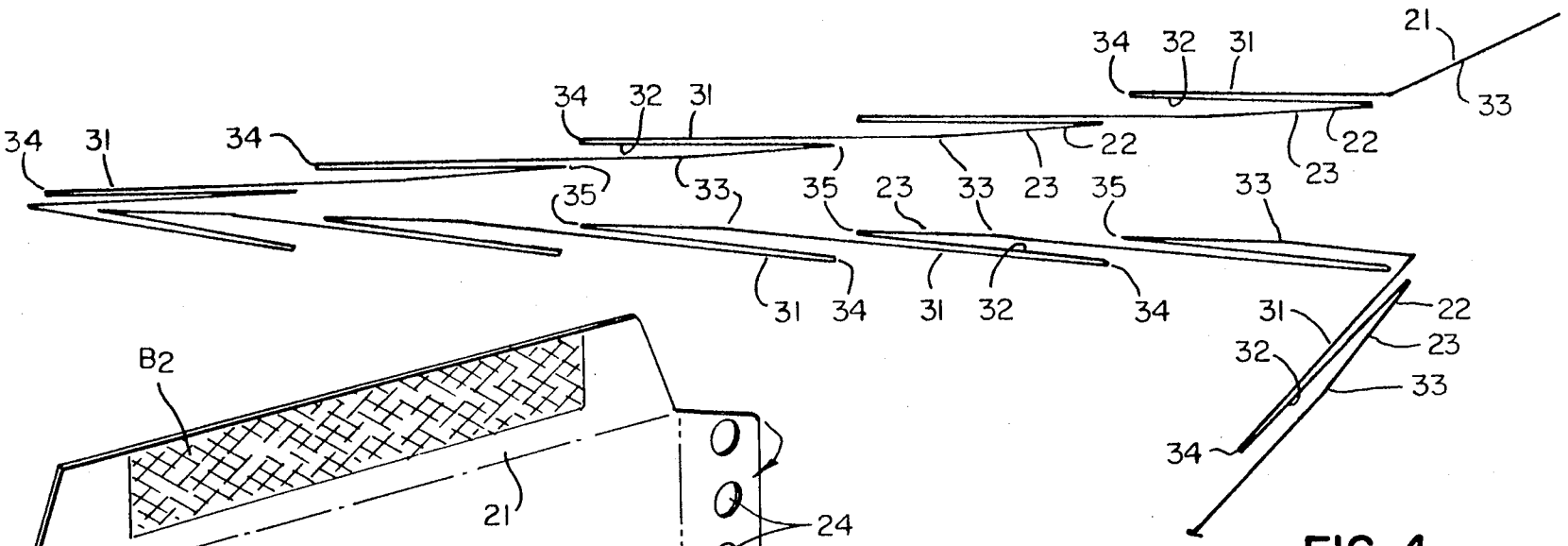
FIG. 4 is a cross-section on line 4—4 in FIG. 3.

The article of stationery shown in FIGS. 3 and 4 comprises a plurality of envelopes 20 in fanfold form which are attached to one another by a first seal tab 21 at the top of each envelope being attached to a second seal tab 22 at the back of each envelope via a perforated tear line 23.

The sides of each of the envelopes has sprocket holes 24 to enable the article to pass through a sprocket feed printer.

Figure 5:
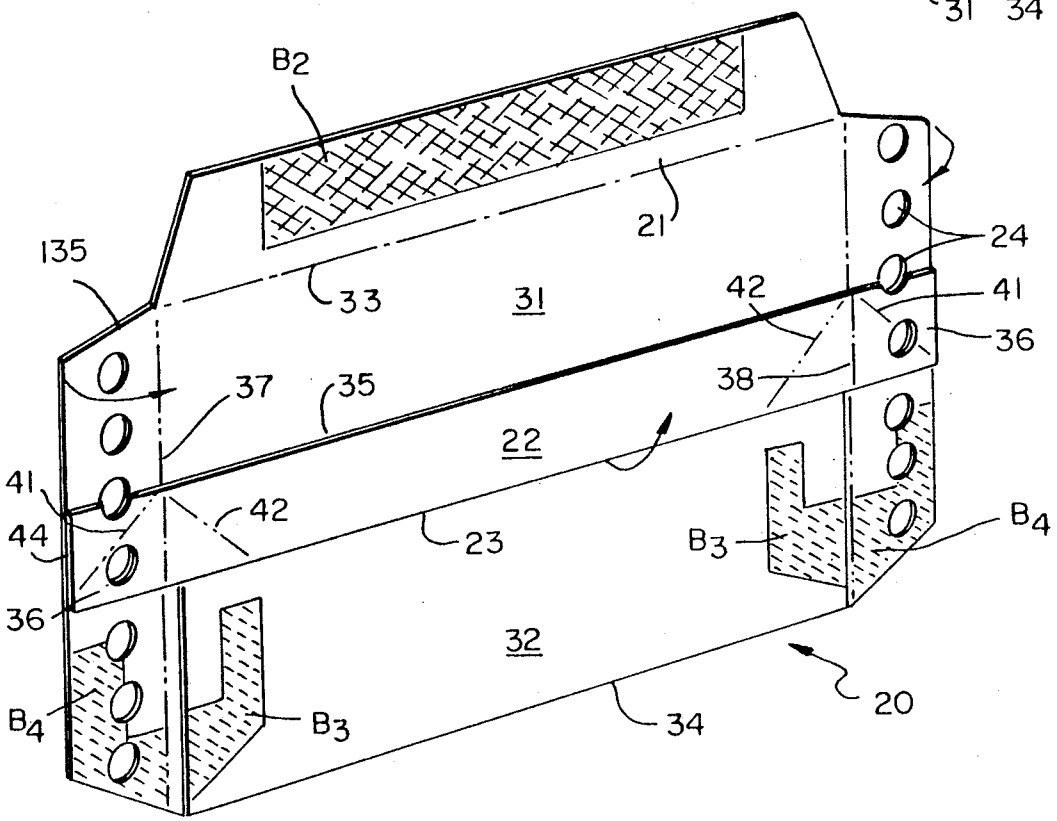
FIG. 5 is a perspective view of an individual envelope separated from the article of stationery shown in FIG. 3.

The form of each envelope 20 will be better understood from FIG. 5 and FIGS. 1 and 2.

Referring to FIG. 5 and FIGS. 1 and 2 each individual envelope 20 was formed with others by folding a sheet.

The sheet may be considered to have a front or front surface, as shown in FIG. 1, on which the face or face panel 31 and rear or rear panel 32 of each envelope is uppermost, and a back or back surface, as shown in FIG. 2, on which the face 31 and rear 32 of each envelope is downward.

The sheet is provided with a line of preferential folding 33 for the first said tab 21, lines 34 and 35 on which the sheet is actually folded to form each individual envelope and in respect of line 35 to be unfolded in use to erect the second seal tab 22 for sealing with the first seal tab 21 and the perforated tear line 23.

In addition, the sheet has side flaps 135 and 36 defined by perforated lines 37 and 38. In a modification lines 37 and 38 are lines of preferential folding.

The side flaps 36 and the second seal tab 22 have lines of preferential folding 41 and 42.

Adhesive of type A is applied to regions A2 on the side flap 36 (defined by line 35, side edges 44 and line 41).

Adhesive of type B is applied to regions B1 (second seal tab 22). B2 (first seal tab 21). B3 (adjacent side edge 45), and B4 (side flaps 135).

Alternatively adhesive of type C may be applied to one of areas B1 and B2 and no adhesive is applied to the other of areas B1 and B2.

Adhesive of type A is intended to bond parts of the envelopes together after folding to form the article shown in FIG. 3 and in this respect areas A2 are brought into juxtaposition with the side flaps 135 to bond them by folding on lines 35.

Adhesive of types B and C are intended to bond parts of the envelope together after printing and separation from the article for sealing and dispatch to an addressee.

Adhesive of types A, B and C may be one and the same if desired but may alternatively be different.

The sheet shown in FIGS. 1 and 2 is folded and bonded and aforesaid to form the article of FIG. 3.

To enable the article of stationery shown in FIG. 3 to be in fanfold form each nth envelope is provided with a line of preferential folding 61 where "n" is the number of envelopes to be in each fold of the fanfold form. A convenient value for "n" is 5.

The article of FIG. 3 can pass through printers to print addresses and after printing the individual envelopes may be separated by tearing on lines 23 to form the individual envelopes such as shown in FIG. 5.

After separation of the envelopes the second seal tabs are unfolded as indicated in FIGS. 6–8 and in so doing the side flap 135 will be caused to overlie the side edges 45 which are otherwise unbonded so that the adhesive areas B3 and B4 contact and bond. Thereafter, the first seal tab 21 can be folded over the second seal tab 22 and the adhesive areas B1 and B2 can bond.

An alternative way of using the article shown in FIG. 3 is to strip the side flaps 135 and 36 from the article on perforation lines 37 and 38. However, if this is intended to be done then the adhesive areas 83 and 84 should be located as shown in FIG. 10.

Figure 10:
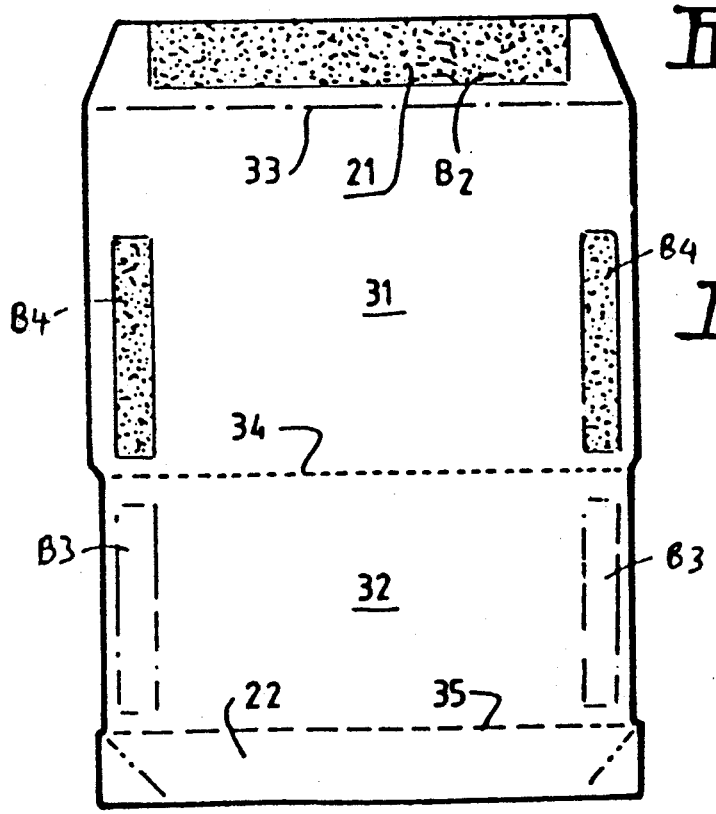
FIG. 10 is a view corresponding to FIG. 2 but of a modified sheet.

It is to be noted that the adhesive in areas B3 and B4 in FIGS. 1 and 2 and in FIG. 10 do not extend to line 34 so as to allow a slight gap for escape of air which may be entrapped in passing through pinch rollers such as of a printer.

Figure 9:
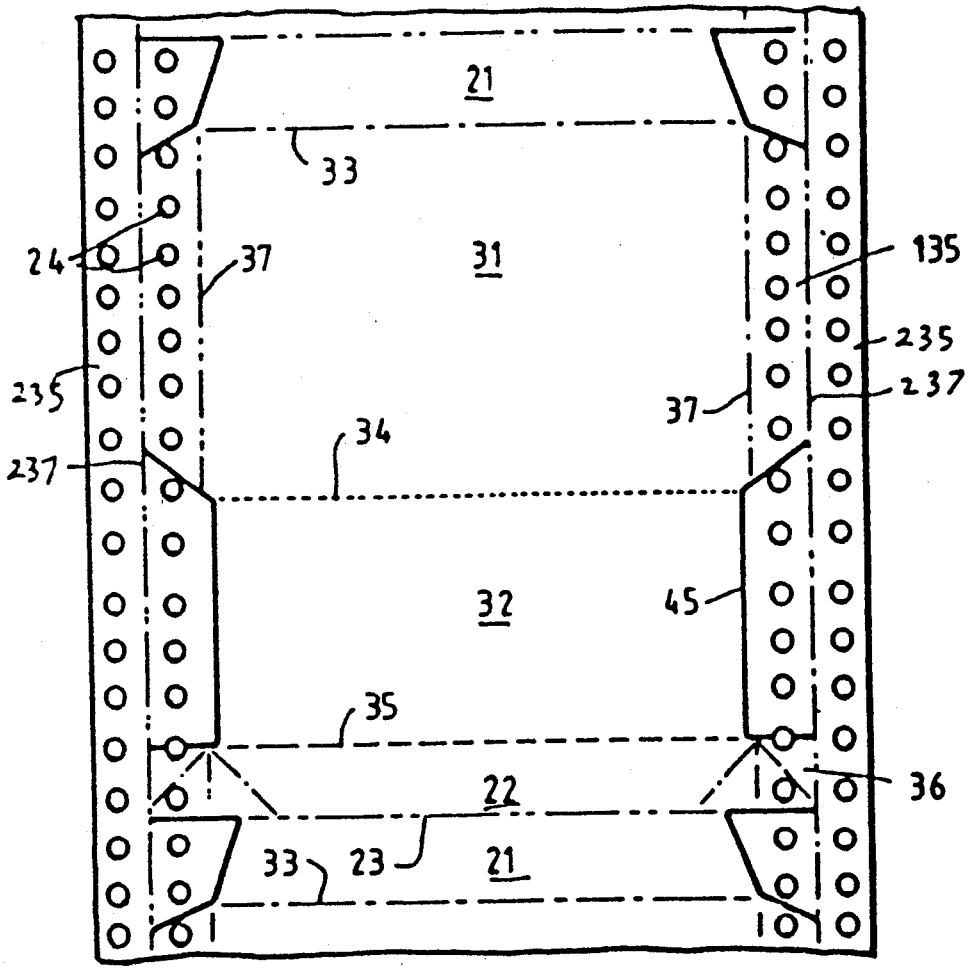
FIG. 9 is a modified version of the sheet of paper of FIG. 1.

The modification shown in FIG. 9 has additional sprocket holes in side edges 235 which may be separated on perforated lines 237. These additional sprocket holes may be found useful in the actual manufacture of the sheet shown in FIG. 9.

Figure 11:
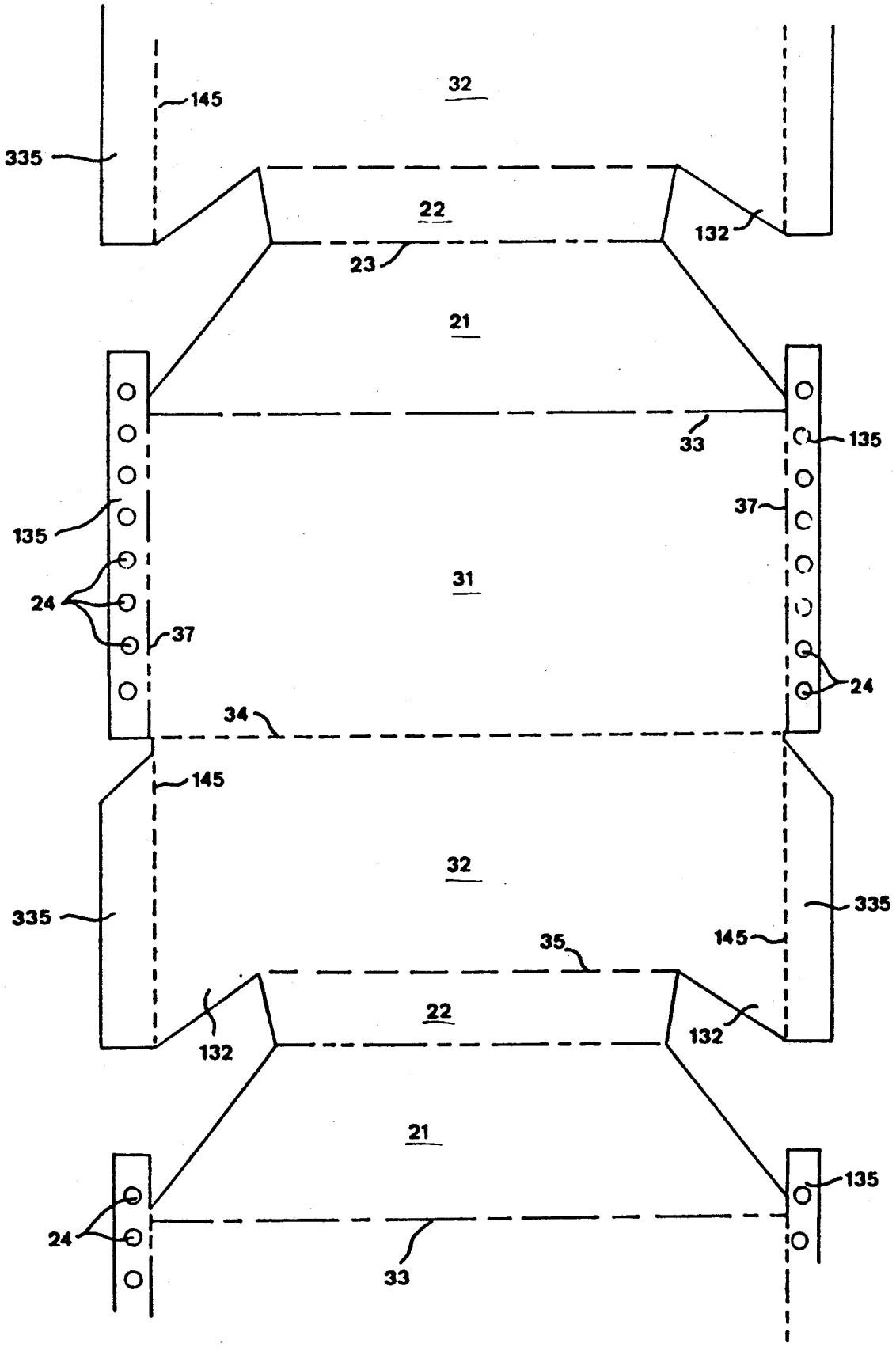
FIG. 11 is a plan view from one side of a sheet of paper used to form an article of stationery in accordance with this invention, which article being shown in FIGS. 12–18.

The article of stationery shown in FIGS. 12–18 and the sheet of paper shown in FIG. 11 are similar to those shown in FIGS. 3 and 4 and 1 and 2 and like reference numerals denote like parts.

The following significant modifications are however to be noted.

Adhesive areas B1, B3 and B4 are omitted.

The side flap regions 36 and the associated adhesive areas A2 are omitted.

The rear panel 32 is provided with side flaps 335 which are provided with adhesive regions. In formation of an envelope, the side flaps 335 are folded along fold lines 145 so as to locate against and be secured to the inside of the face panel 31 of the envelope that is the sides of the flaps 335 seen in FIG. 11 are secured to the side of the face panel 31 seen in FIG. 12. The thus formed envelope (see FIG. 16) will be seen apart from the side edges 135 and sprocket holes, to be "like" a conventional envelope and if the line 37 is a line of perforations those side edges 135 may be stripped away.

Figure 18:
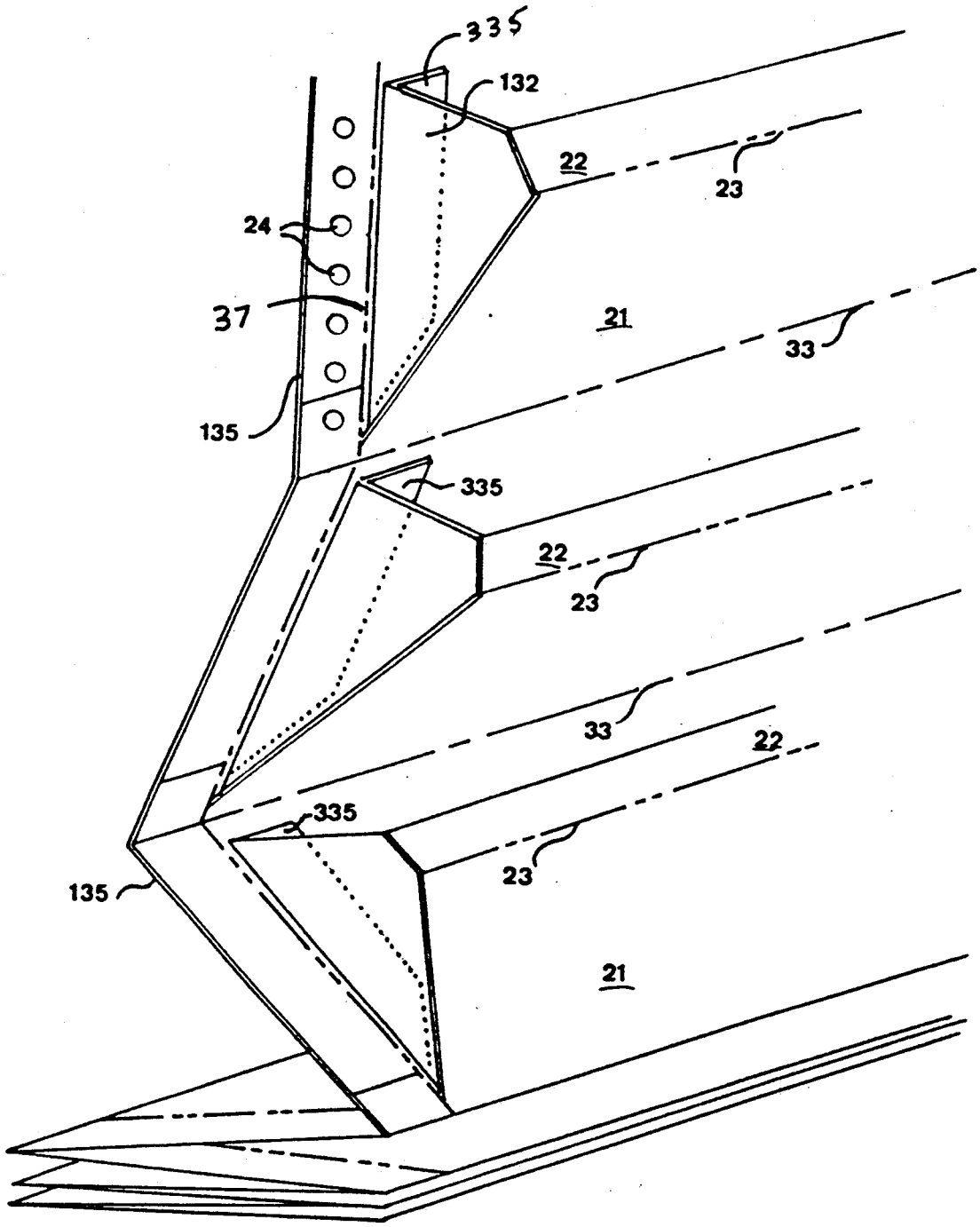
FIG. 18 is a perspective view of the article of 6 stationery formed by folding the sheet shown in FIG. 11.

Adhesive is provided on the side flaps 135 and in use will secure the side flaps 135 to the next adjacent envelope by bonding to the upper end (with respect to FIG. 11) of that side of flaps 135 seen in FIG. 11 of the next adjacent envelope. This is illustrated in FIG. 18.

The length of the first seal tab 21, second seal tab 22, face 31 and rear 32 as viewed down the page with respect to FIG. 11 facilitate fanfolding about line 34.

Figure 12:
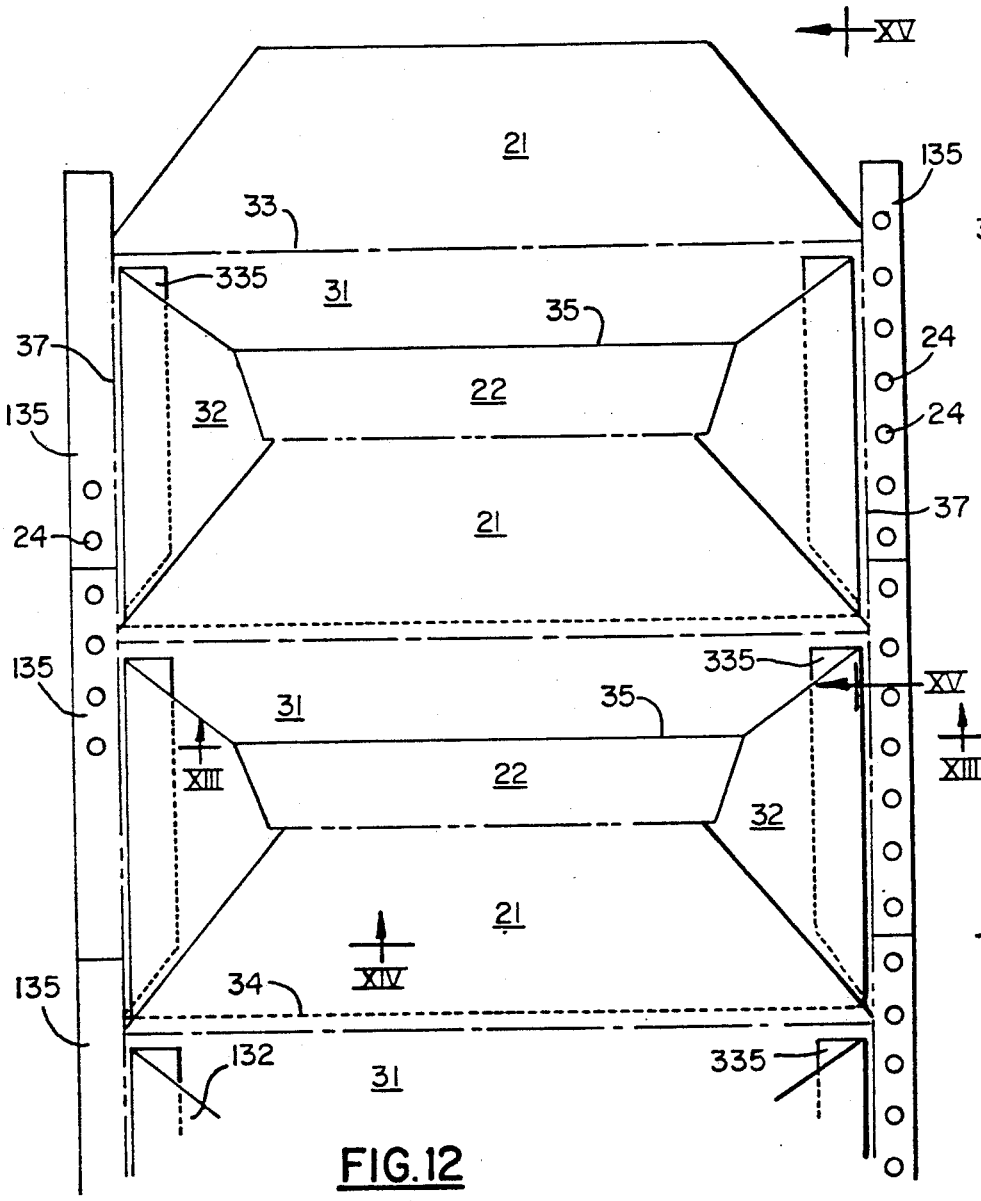
FIG. 12 is a plan view of the article of stationery formed by folding the sheet shown in FIG. 11.
Figure 15:
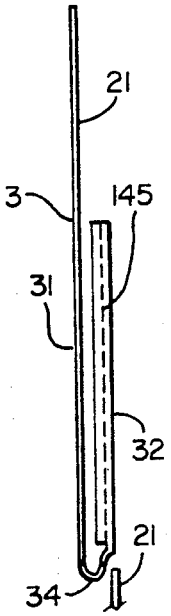
FIG. 15 is another cross-sectional view of the article of stationery formed by folding the sheet shown in FIG. 11.
Figure 13:
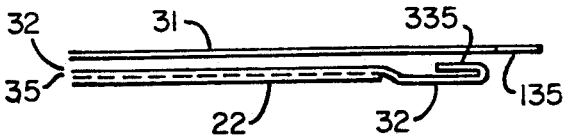
FIG. 13 is a partial cross-sectional view of the article of stationery formed by folding the sheet shown in FIG. 11, and taken along line XIII—XIII of FIG. 12.
Figure 14:
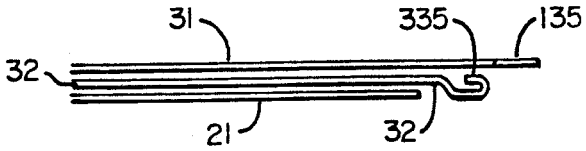
FIG. 14 is another partial cross-sectional view of the article of stationery formed by folding the sheet shown in FIG. 11, and taken along line XV—XV of FIG. 12.
Figure 16:
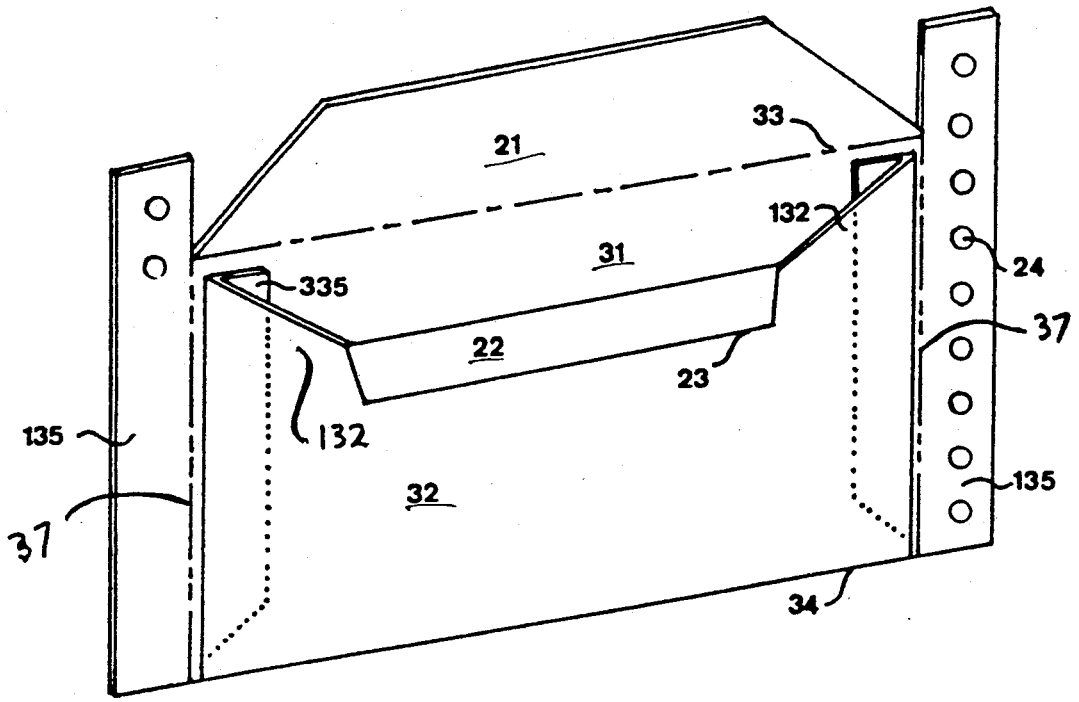
FIG. 16 is a perspective view of part of the article of stationery formed by folding the sheet shown in FIG. 11.
Figure 17:
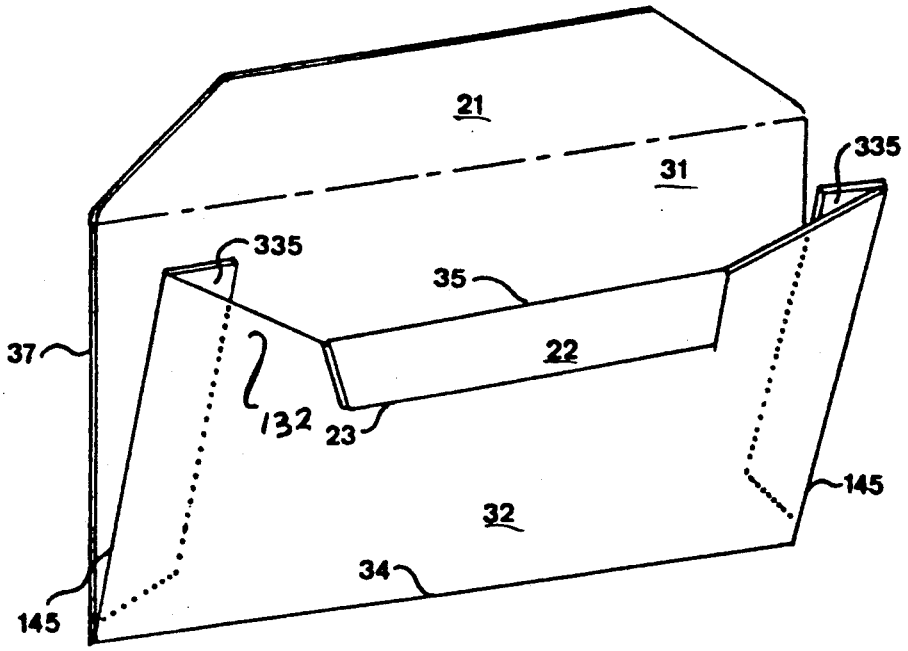
FIG. 17 is a perspective view of part of the article of stationery formed by folding the sheet shown in FIG. 11 but partially opened.

The side flaps 335, first tab 21 and second tab 22 are shaped so that no part of first tab 21 and second tab 22 overlies side flaps 335 as can be seen in FIG. 12 so that the article of stationery is nowhere more than 3 layers of paper thick.

The line of perforations 37 is outboard of the side 145 of the back 32 so that the side edges 135 may be stripped away with a rotary knife without fear of damage to the backs 32 of the envelopes.

Further, the side flaps 335 and regions 132, extend almost to the line 33 and strengthen the sides of the envelope in the region of line 33.

I claim:

1. An article of stationary comprising a continuous length of paper or other material suitable for envelope formation folded to define a plurality of envelopes wherein each envelope, excepting that one at one end of the length, partly overlaps and is attached to a first adjacent envelope and, excepting that one at the other end of the length, is partly overlapped by and is attached to another, second, adjacent envelope, wherein each envelope comprises a face panel and a back panel and wherein at least substantially the whole of the face panel of each envelope is not overlapped by an adjacent envelope wherein aid article of stationery is, at least substantially throughout the whole of its length not more than 3 layers thick of said paper or other material suitable for envelope formation and wherein such article of stationery is, at least substantially throughout the whole of the width of each envelope, not more than 3 layers thick of said paper or other material suitable for envelope formation.

2. An article of stationery as claimed in claim 1, wherein said article of stationery is, at least substantially throughout the whole of the length and width of each envelope and of a substantially constant thickness of 3 layer thick of said paper or other material suitable for envelope formation.

3. An article of stationery as claimed in claim 1, wherein attached to the face panel of each envelope is a first tab adapted to be folded to the rear of the envelope to seal the envelope.

4. An article of stationery as claimed in claim 3, wherein the first tab is joined to the face panel via a line real, imaginary or of preferential folding, and the back panel, at least adjacent the side edges thereof, extends substantially to that line.

5. An article of stationery as claimed in claim 3, and in fanfold form.

6. An article of stationery as claimed in claim 5, including lines of preferential folding in certain ones of said envelopes to facilitate such fan folding.

7. An article of stationery as claimed in claim 6, wherein the first tab is attached to the face panel of each envelope about a line of preferential folding and said article of stationery is adapted to fanfold at that line.

8. An article of stationery as claimed in claim 3, wherein the first tab is attached to the back panel of an adjacent envelope.

9. An article of stationery as claimed in claim 3, wherein the first tab is attached to an adjacent envelope via a removable portion.

10. An article of stationery as claimed in claim 3, wherein attached to the back panel of each envelope is a second tab over or under which the first tab may be folded to seal the envelope and wherein adjacent envelopes are attached to one another through the first tab of one envelope being attached and contiguous to a removable portion intermediate the first tab and the second tab of an adjacent envelope.

11. An article of stationery as claimed in claim 10, wherein said removable portion is defined by lines of preferential tearing at intersections with the first tab and the second tab.

12. An article of stationery as claimed in claim 3, wherein attached to the back panel of each envelope is a second tab over or under which the first tab may be folded to seal the envelope.

13. An article of stationery as claimed in claim 12, wherein the first tab is joined to the face panel via a line, real, imaginary or of preferential folding, and the back panel, at least adjacent the side edges thereof, extends substantially to that line and wherein the second tab is folded to overlie the back panel along a fold and wherein said fold line is relatively more adjacent the bottom of the envelope than those regions of the back panel adjacent the side edges thereof which are most proximate to that line between the first tab and the face panel.

14. An article of stationery as claimed in claim 12, wherein one or both of the first tab and the second tab is provided with an adhesive for sealing the envelope.

15. An article of stationery as claimed in claim 12, wherein the second tab or an extension thereof is connected to the side edges of the respective envelope so as to cause folding of those side edges to overlap the back panel when the second tab is unfolded as aforesaid.

16. An article of stationery as claimed in claim 15, wherein lines of preferential folding are provided spaced from side edges and in the second tab or said extension to facilitate such folding of the side edges.

17. An article of stationery as claimed in claim 15, wherein one of said back panel and said side edges is provided with an adhesive adapted to retain said side edges in such folded condition.

18. An article of stationery as claimed in claim 12, wherein adjacent envelopes are attached to one another through the first tab of one envelope being attached and contiguous to the second tab of an adjacent envelope.

19. An article of stationery as claimed in claim 18, wherein the envelopes have side edges extending from the sides of the back panel which are folded inwardly and secured to the inside of the front whereby to close the sides of the envelopes and wherein the first tab and the second tab are so shaped as to not overlie said side edges extending from the sides of the back panel which are folded inwardly.

20. An article of stationery as claimed in claim 18, wherein the length of the first tab and the length of the second tab are such that at least substantially the whole of the face panel of each envelope is not overlapped by an adjacent envelope.

21. An article of stationery as claimed in claim 18, wherein the length of the first tab and the length of the second tab are such that the whole of the face panel of each envelope is not overlapped by an adjacent envelope.

22. An article of stationery as claimed in claim 18, wherein the sum of twice the length of the first tab and the length of the second tab, is not less than the length of the face panel of the envelope.

23. An article of stationery as claimed in claim 18 wherein the sum of twice the length of the first tab and the length of the second tab, is not greater than the length of the face panel of the envelope plus not more than 10 mm.

24. An article of stationery as claimed in claim 18, wherein the length of the first tab and the length of the second tab is such that, when the first tab is folded to seal the envelope, the first tab overlies and wholly covers the second tab.

25. An article of stationery as claimed in claim 18, wherein the attachment of the first tab of one envelope to the second tab of an adjacent envelope is via a line of preferential tearing along which the envelopes may be separated.

26. An article of stationery as claimed in claim 18, wherein the second tab of each envelope is folded to overlie the back panel of the envelope.

27. An article of stationery as claimed in claim 13, wherein the second tab is unfoldable from that position overlying the back panel whereby the first tab may be folded to overlie or underlie the second tab to seal the envelope.

28. An article of stationery as claimed in claim 26, wherein the second tab is secured to the back panel of the envelope in such overlying the back of the envelope condition.

29. An article of stationery as claimed in claim 28, wherein the second tab is detachably secured to the back panel of the envelope in such overlying the back panel of the envelope condition by an adhesive from which securement the second tab is capable of being de-adhered.

30. An article of stationery as claimed in claim 28, wherein the second tab is secured to the back panel of the envelope in such overlying the back panel of the envelope condition by an adhesive from which the second tab is incapable of being de-adhered without substantial likelihood of tearing of said paper or other material suitable for envelope formation.

31. An article of stationery as claimed in claim 30, wherein the length of the first tab and the length of the second tab is such that, when the first tab is folded to seal the envelope, the first tab overlies the wholly covers the second tab.

32. An article of stationery as claimed in claim 1, wherein said article of stationery has side edges provided with sprocket holes for use with sprocket feed printers.

33. An article of stationery as claimed in claim 32, wherein such perforations, and/or lines of preferential folding or tearing which extend across the side edges either do not extend in lines which pass through the sprocket holes or extend in lines which pass through substantially the centre of a sprocket hole.

34. An article of stationery as claimed in claim 32, wherein said edges are attached to the envelopes via a line of preferential tearing whereby said side edges may be stripped from the envelope.

35. An article of stationery as claimed in claim 32, and including a second set of sprocket holes in said side edges outboard of the first mentioned sprocket holes.

36. An article of stationery as claimed in claim 32, wherein said second set of sprocket holes is spaced from the first mentioned sprocket holes by a region having a line of preferential tearing whereby that part of the side edges having said second set of sprocket holes may be stripped form the envelopes.

37. An article of stationery as claimed in claim 32, wherein said side edges are continuous along the whole length of said article of stationery.

38. An article of stationery as claimed in claim 37, wherein said side edges comprises regions wherein said length of material is overlapped on itself.

39. An article of stationery as claimed in claim 38, wherein said side edges are provided with adhesive regions whereby to secure such overlapped regions together.

40. An article of stationery as claimed in claim 39, wherein said adhesive regions are located such as to secure the side edges associated with one envelope adjacent the bottom thereof to the side edges associated with the adjacent envelope which is overlapped thereby.

41. An article of stationery as claimed in claim 1, wherein the face panel and back panel of each envelope are not secured together in a region along their side edges whereby to permit air entrapped in each envelope in passing through a mechanism to escape.

42. An article of stationery as claimed in claim 1, wherein the face panel and back panel of each envelope are bonded together inboard of said side edges.

43. An article of stationery as claimed in claim 1, wherein the envelopes have side edges extending from the sides of one of the front panel and the back panel which are folded inwardly and secured to the other of the front panel and the back panel whereby to close the sides of the envelopes.

44. An article of stationery as claimed in claim 1, wherein the envelopes have side edges extending from the sides of the back panel which are folded inwardly and secured to the inside of the front panel whereby to close the sides of the envelopes.

45. An article of stationery as claimed in claim 44, wherein the side edges extending from the sides of the back panel which are folded inwardly are provided with sprocket holes to facilitate transport of said length prior to such folding inwardly.

46. An article of stationery as claimed in claim 44, wherein the front panel has side edges extending laterally outwardly of the envelopes and provided with sprocket holes for use with sprocket feed printers.

47. An article of stationery as claimed in claim 44, wherein said article of stationery has side edges provided with sprocket holes for use with sprocket feed printers.

48. An article of stationery as claimed in claim 47, wherein said side edges are attached to the envelopes via a line of preferential tearing whereby said edges may be stripped from the envelopes.

49. An article of stationery as claimed in claim 1, wherein the envelopes have side edges extending from the sides of the back panels and integral therewith which are folded inwardly and secured to the inside of the front panels whereby to close the sides of the envelopes, wherein the envelopes have side edges integral with the front panels and extending laterally outwardly of the envelopes and provided with sprocket holes for use with sprocket feed printers, wherein said side edges integral with the front panels are attached to the envelopes via a line of preferential tearing whereby said side edges may be stripped from the envelope, and wherein said line of preferential tearing is located laterally outboard of the sides of the back panels of the envelopes.

50. An article of stationery as claimed in claim 49, wherein said side edges integral with the front panels are continuous along the whole length of said article of stationery.

51. An article of stationery as claimed in claim 50, wherein said side edges integral with the front panels comprise regions wherein said length of material is overlapped on itself.

52. An article of stationery as claimed in claim 50, wherein in the regions of said article of stationery in which part of one envelope overlaps part of another, adjacent, envelope the side edges of, respectively, the overlapping envelope or the overlapped envelope in way of the sprocket holes therein extend relatively more laterally than, respectively, the side edges of the overlapped envelope or the overlapping envelope whereby, in use, a sprocket feed mechanism will engage with sprocket holes in the parts of the side edges which extend relatively more laterally and not with, respectively, the side edges of the overlapped envelope or the overlapping envelope.

* * * * *